US005777591A

United States Patent [19]

Katoh et al.

[11] Patent Number: 5,777,591

[45] Date of Patent: Jul. 7, 1998

[54] MATRIX DISPLAY APPARATUS EMPLOYING DUAL SWITCHING MEANS AND DATA SIGNAL LINE DRIVING MEANS

[75] Inventors: Kenichi Katoh, Tenri; Hiroshi Yoneda, Ikoma, both of Japan

[73] Assignee: Sharp Kabushiki Kaisha, Osaka, Japan

[21] Appl. No.: 238,517

[22] Filed: May 5, 1994

[30] Foreign Application Priority Data

May 6, 1993 [JP] Japan ..... 5-105741

[51] Int. Cl.[6] ..... G09G 3/36

[52] U.S. Cl. ..... 345/92; 345/103

[58] Field of Search ..... 345/90–93, 103

[56] References Cited

U.S. PATENT DOCUMENTS

| | | | |
|---|---|---|---|
| 4,680,580 | 7/1987 | Kawahara | 345/93 |
| 4,870,396 | 9/1989 | Shields | 345/90 |

FOREIGN PATENT DOCUMENTS

| | | | |
|---|---|---|---|
| 2-43622 | 2/1987 | Japan . | |
| 1-291216 | 11/1989 | Japan | 345/92 |
| 3-71185 | 3/1991 | Japan | 345/92 |

*Primary Examiner*—Jeffery Brier

[57] ABSTRACT

A matrix display apparatus includes a matrix of pixels divided into a plurality of groups of pixels and data signal lines for delivering a data signal to a pixel. The data signal lines are distributed along the direction of a column. The apparatus also includes scanning signal lines for applying a scanning signal to a pixel, the scanning signal lines being distributed along the direction of a row. The apparatus also includes a first switch, disposed from each of the plurality of pixels, for allowing the data signal to be applied to the corresponding pixel based on the scanning signal. The apparatus also includes a second switch, disposed for each of the pixels in at least one of the plurality of the pixel groups, for controlling a timing for allowing the data signal to be applied to the corresponding pixel. The second switch is connected in series to the first switch between the first switch and the data signal line. The apparatus further includes a data signal line driver for sampling an image signal for each of the plurality of scanning signal lines at a predetermined timing within a horizontal scanning period for the corresponding data signal line and for outputting the sampled image signal to the corresponding data signal line as the data signal, the data signal being applied to at least one of the plurality of the pixel groups for a horizontal scanning period and a portion of an adjacent horizontal scanning period.

11 Claims, 12 Drawing Sheets

Sg
H

SD1
H
t1

SD2
t2

SD3
t3

SC0

SC1
T1
A
B
D1
t4
t5

SC2
Hα
H

C1
t6
t7
T2

C2
t10
t8
t9
T3
C

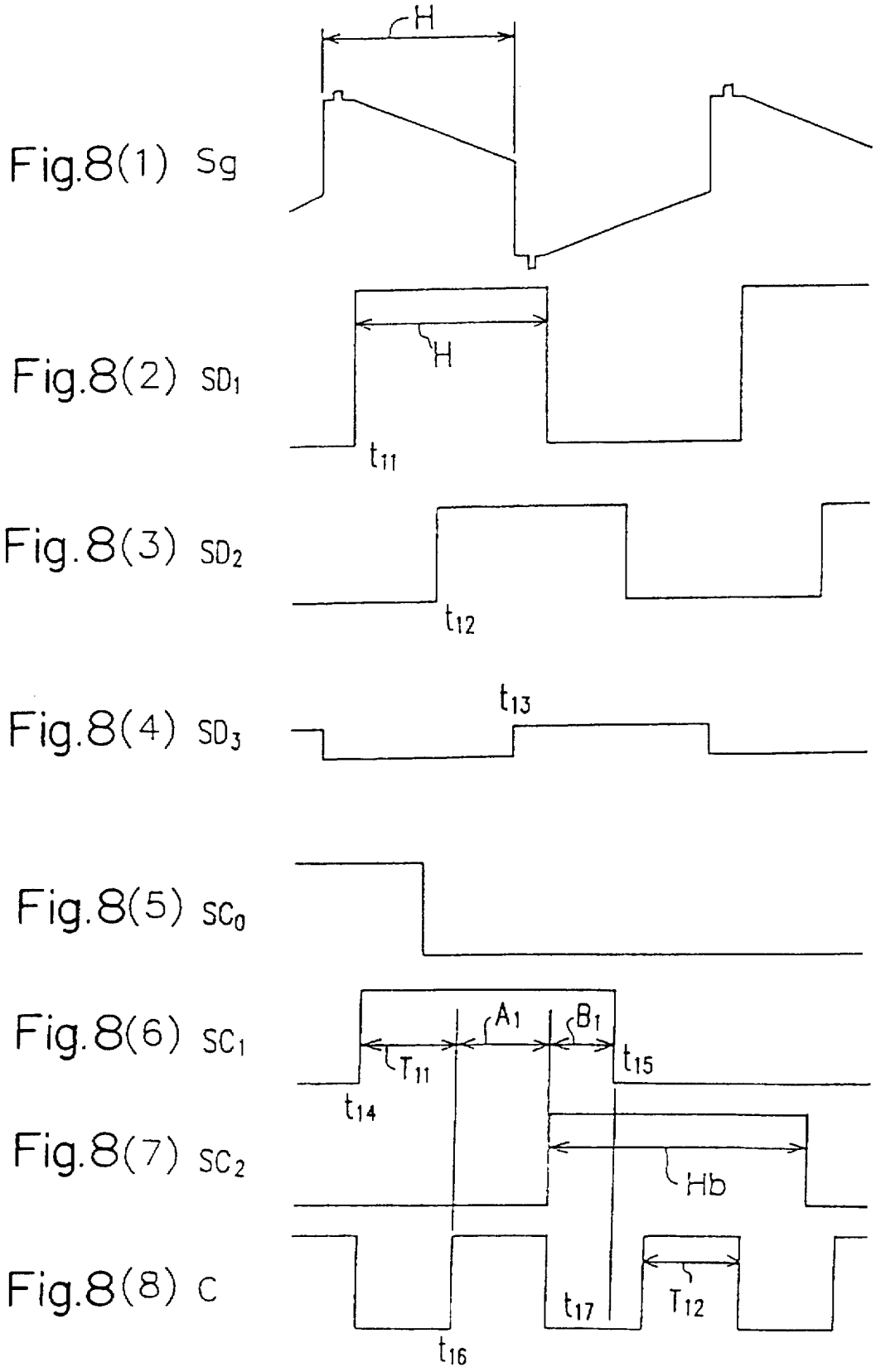
Fig.8(1) Sg
H
Fig.8(2) SD1
H
t11
Fig.8(3) SD2
t12
Fig.8(4) SD3
t13
Fig.8(5) SC0
Fig.8(6) SC1
A1
B1
T11
t14
t15
Fig.8(7) SC2
Hb
Fig.8(8) C
t16
t17
T12

Sg
H

SD1
H
t21

SD2
t22

SD3
t23
C2

SC0

SC1
t24
A2
B2
t25

SC2
Hc
t26

Fig.15(1) Sg
PRIOR ART
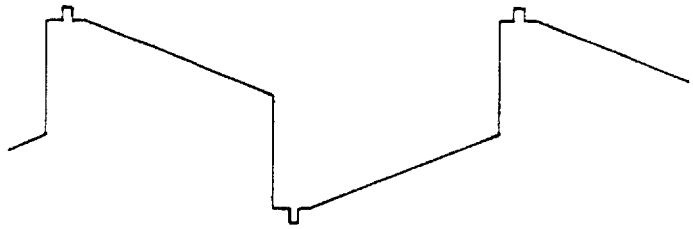
Fig.15(2) $SD_1$
PRIOR ART
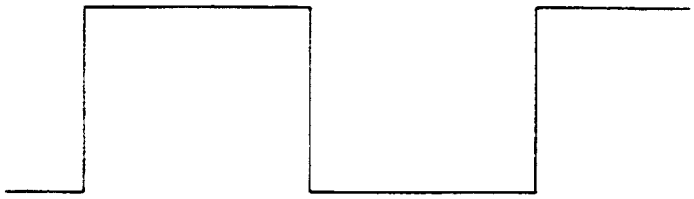
Fig.15(3) $SD_2$
PRIOR ART
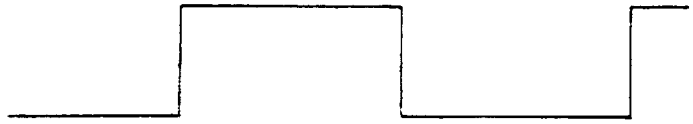
Fig.15(4) $SD_3$
PRIOR ART
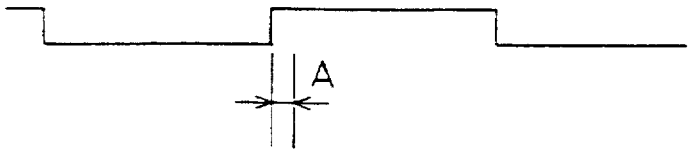
Fig.15(5) $SC_1$
PRIOR ART
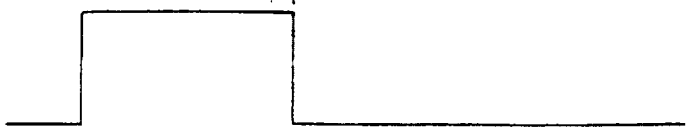
Fig.15(6) $SC_2$
PRIOR ART
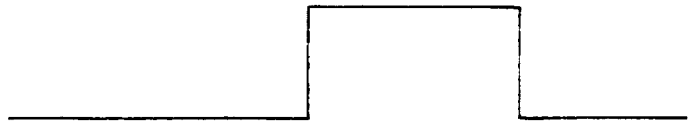

MATRIX DISPLAY APPARATUS EMPLOYING DUAL SWITCHING MEANS AND DATA SIGNAL LINE DRIVING MEANS

BACKGROUND OF THE INVENTION

1. Field of the Invention

The present invention relates to, for instance, a matrix display apparatus such as an active matrix liquid type crystal display apparatus and a method for driving the same.

2. Description of the Related Art

FIG. 13 is a block diagram showing a conventional active matrix type liquid crystal display apparatus 1 (referred to as the display apparatus hereinafter) using a thin film transistor (referred to as TFT hereinafter). FIG. 14 is an electric equivalent circuit diagram of a pixel 2 of the display apparatus 1. Conventionally, the display apparatus 1 has a structure in which a scanning substrate 3 and an counter substrate are opposed to each other and a liquid crystal layer is sandwiched therebetween and sealed with a sealing material at the periphery of the substrates. On the scanning substrate 3, a plurality of data signal lines 4 parallel to one another and a plurality of scanning signal lines 5 parallel to one another are disposed. The scanning signal lines 5 extend perpendicularly to the extending direction of the data signal lines 4. The pixels 2 are arranged on the scanning substrate 3 in the form of a matrix of M rows by N columns. Each of the pixels 2 is disposed in the vicinity of the respective intersections at which the plurality of data signal lines 4 and the plurality of scanning signal lines 5 cross each other.

As shown in FIG. 14, each of the pixels 2 is composed of an equivalent capacitor 6 of the liquid crystal layer and a storage capacitor 7. Each of the pixels 2 is connected to a drain of a TFT 8 provided for each of pixels 2. In the TFT 8, a gate is connected to the scanning signal line 5 and a source is connected to the data signal line 4. Each of the TFTs 8 is electrically switched between a conductive state and a non-conductive state, by the scanning signal from the scanning signal line 5. The data signal lines 4 are connected to the data output circuit 9. The scanning signal lines 5 are connected to the scanning circuit 10.

FIG. 15 is a time chart showing the operation of the display apparatus 1. Referring also to FIG. 15, the display operation of the display apparatus 1 will be described. An image signal Sg shown in (1) of FIG. 15 is input into the data output circuit 9. Polarity of this image signal Sg is reversed for each horizontal scanning period. The data output circuit 9 samples the image signal Sg at predetermined intervals of time within the horizontal scanning period, while outputting to each of the data signal lines 4 the sampled image signal Sg for each period of the horizontal scanning. Thus the potential of the data signal lines 4 becomes as shown by the waveforms of (2)–(4) of FIG. 15.

Assuming that the number of the data signal lines 4 is N, a data signal of (2) of FIG. 15 represents a potential at the 1st column of data signal line 4, a data signal of (3) of FIG. 15 a potential at the (N/2)th column of data signal line 4, and a data signal of (4) of FIG. 15 a potential at the Nth column of data signal line 4. In FIG. 15, (5)–(6) show the waveforms of the scanning signals applied by the scanning circuit 10 to the mth and to the (m+1)th rows of the scanning signal line 5, respectively, where $1 \leqq m \leqq M-1$.

The data signal applied to the data signal line 4 is written into the pixel during a time period which starts when the TFT 8 is turned ON and terminates when the scanning signal in the scanning signal line 5 becomes less than the threshold voltage of the TFT 8 and the TFT 8 becomes OFF.

In conventional drive methods, a scanning signal applied to the scanning line 5 must fall within a blanking period in the horizontal scanning period of the image signal Sg, since the data signal applied to the data signal line 4 is changed into an effective display period in the horizontal scanning period. Therefore, a time period A shown in FIG. 15, which starts by the changeover of the data signal in the Nth row of data signal line 4 and terminates by the fall of the scanning signal at the scanning signal line 5 corresponding to the current horizontal scanning period, is at maximum about 20% of the horizontal scanning period. Since the ratio of the blanking period to the horizontal scanning period is constant, increase of the number of scanning signal lines 5 necessarily shortens the time length of the time period A. As a result, it is difficult for the pixel 2 connected to the data signal line 4 in the vicinity of the Nth row to ensure a writing time long enough for the liquid crystal to change into a predetermined display state, which may cause display irregularities in a display panel.

Among conventional arts addressing such problems, there is a technique of dividing scanning signal lines as disclosed in Japanese Laid-Open Patent Publication No. 62-43622. In this kind of conventional art, the scanning signal lines on a scanning substrate are divided along the direction of columns of the scanning substrate into a plurality of sections each composed of plurality of columns of scanning signal lines so that the scanning signal lines of each section are driven by means of mutually independent signals with different phases.

By this arrangement, a sufficient writing time is assured for the respective pixels within each of the pixel blocks corresponding to one of the above-mentioned sections. However, there are other problems in this arrangement. For example, since a scanning circuit element is required for each of pixel blocks, the number of components of the display apparatus increase. Also, the structure of the scanning substrate becomes complicated due to provision of a large number of scanning circuit elements.

SUMMARY OF THE INVENTION

The matrix display apparatus of this invention comprises: a plurality of pixels arranged in a form of a matrix, divided into a plurality of pixel groups each having at least one column of the pixels; a plurality of data signal lines for applying a data signal to the plurality of the pixels, the plurality of data signal lines being parallel with each other and being disposed between the plurality of pixels along a direction of a column; a plurality of scanning signal lines for applying a scanning signal to the plurality of the pixels, the plurality of scanning signal lines being parallel with each other and being disposed between the plurality of pixels along a direction of a row; first switching means, disposed for each of the plurality of pixels, for allowing the data signal to be applied to the corresponding pixel based on the scanning signal, the first switching means being connected to the corresponding pixel, data signal line and scanning signal line; second switching means, disposed for each of the pixels in at least one of the plurality of the pixel groups, for controlling a timing for allowing the data signal to be applied to the corresponding pixel, the second switching means being connected in series to the first switching means; and data signal line driving means for sampling an image signal for each of the plurality of scanning signal lines at a predetermined timing within a horizontal scanning period for the corresponding data signal line and for outputting the sampled image signal to the corresponding data signal line as the data signal.

In one embodiment of the present invention, the display apparatus further comprises a plurality of control signal lines for applying a control signal to the second switching means, thereby controlling the timing for allowing the data signal to be applied to the corresponding pixel.

In another embodiment of the present invention, the plurality of control signal lines are disposed for the pixels in each of the plurality of pixel groups.

In still another embodiment of the present invention, the plurality of control signal lines are disposed for the pixels in common in the plurality of pixel groups.

According to another aspect of the present invention, a method of driving the above-mentioned matrix display apparatus, includes the steps of outputting the scanning signal for an mth scanning signal line for allowing the data signal to be applied to the pixels connected to the mth scanning signal line for a period including the horizontal scanning period for the mth scanning signal line and a portion of the horizontal scanning period for an (m+1)th scanning signal line, where $1 \leqq m \leqq M-1$ and M is the number of the scanning signal lines, and closing the second switching means in the pixels in the mth scanning line for the portion of the horizontal scanning period for the (m+1)th scanning signal line.

Thus, the invention described herein makes possible the advantages of (1) providing a matrix display apparatus with a simple structure but capable of significant improvement in display image, and of (2) providing a method of driving the same.

These and other advantages of the present invention will become apparent to those skilled in the art upon reading and understanding the following detailed description with reference to the accompanying figures.

BRIEF DESCRIPTION OF THE DRAWINGS

FIG. 8 is a time chart for explaining the operation of display apparatus of the second example.

FIG. 15 is a time chart for explaining the operation of the display apparatus shown in FIG. 13.

DESCRIPTION OF THE PREFERRED EMBODIMENTS

The present invention will be described by way of example with reference to the accompanying drawings as follows:

EXAMPLE 1

Figure 1:
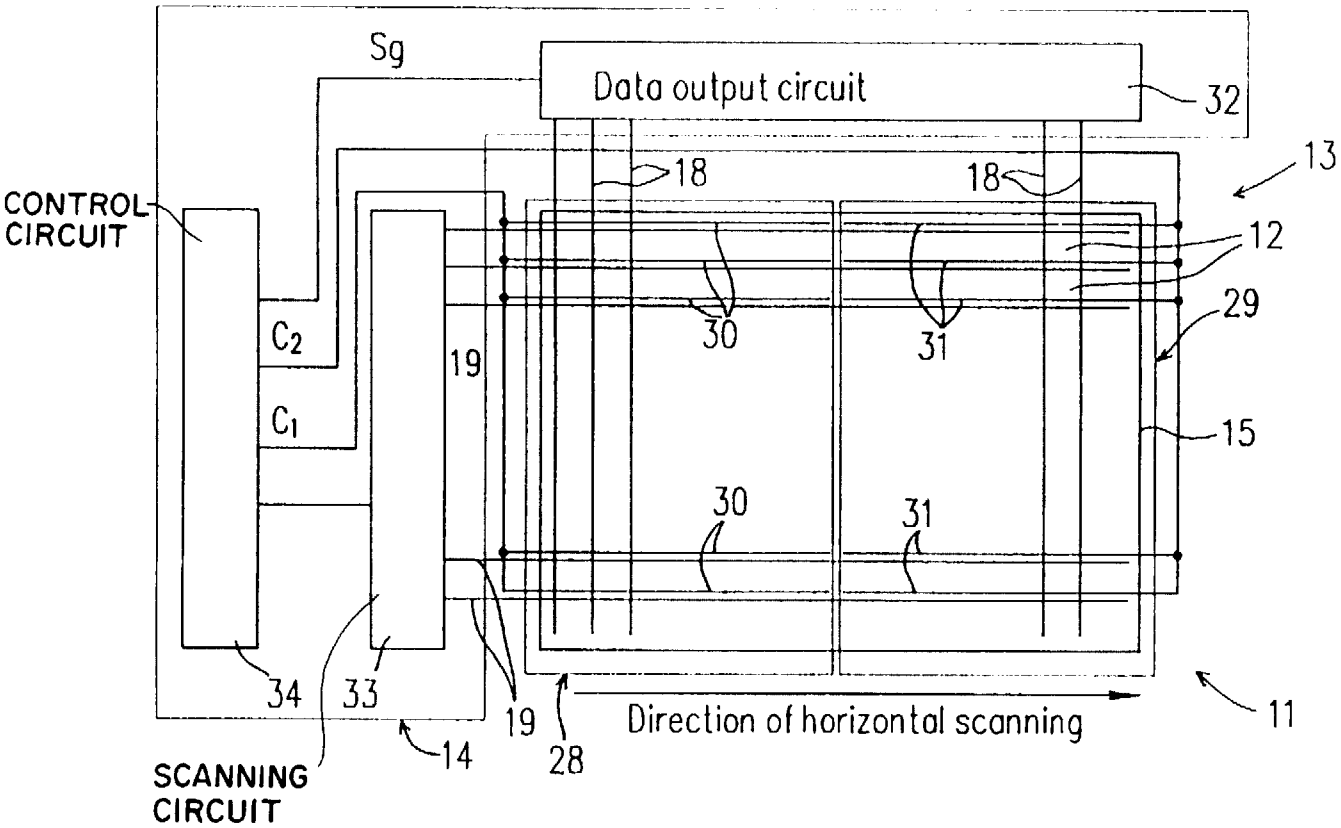
FIG. 1 is a block diagram showing a display apparatus of a first example of the invention.
Figure 2:
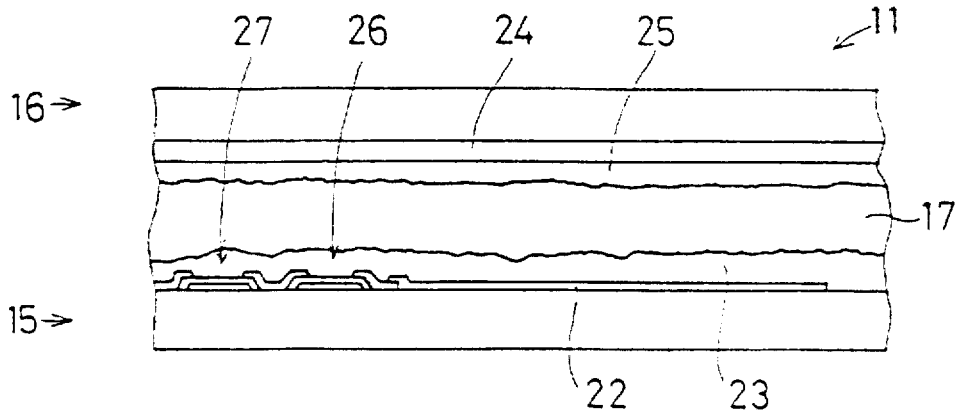
FIG. 2 is a cross sectional view showing the vicinity of a pixel of the display apparatus of the first example.
Figure 3:
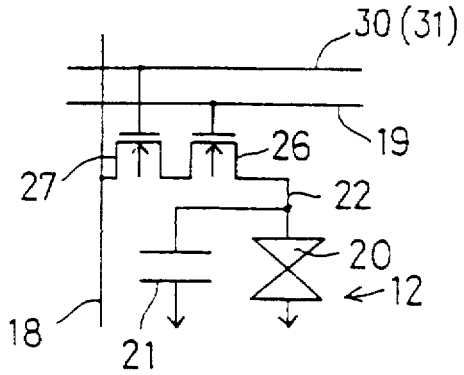
FIG. 3 is an electric equivalent circuit diagram of the vicinity of a pixel of the display apparatus he first example.

FIGS. 1 through 4 show Example 1 of the present invention. FIG. 1 is a block diagram showing an active matrix type liquid crystal display apparatus (referred to as a display apparatus hereinafter) 11 of Example 1 of the present invention. FIG. 2 is a cross sectional view showing the vicinity of each of pixels 12 of the display apparatus 11. FIG. 3 is an electric equivalent circuit diagram of the vicinity of one of the pixels 12 of the display apparatus 11.

As shown in FIG. 1, the display apparatus 11 has a display section 13 and a drive section 14. As shown in FIG. 2, the display section 13 has a structure in which a scanning substrate 15 and a counter substrate 16 are opposed to each other and a liquid crystal layer 17 is sandwiched therebetween and sealed with a sealing material at the periphery of the substrates 15 and 16. The scanning substrate 15 has a plurality of pixel electrodes 22 arranged in the form of a matrix of M rows by N columns and an alignment film 23. The counter substrate 16 has a counter electrode 24 and an alignment film 25. On the scanning substrate 15, N columns of data signal lines 18 parallel with one another and M rows of scanning signal lines 19 parallel with one another are disposed between the plurality of pixel electrodes 22 of the matrix-form. The scanning signal lines 19 extend perpendicularly to the direction of the data signal lines 18. The pixels 12 each having one of the pixel electrodes 22 are disposed in the vicinity of the respective intersections at which the plurality of data signal lines 18 and the plurality of scanning signal lines 19 cross each other.

In Example 1, the pixels 12 arranged in the form of a matrix of M rows by N columns on the scanning substrate 15 are divided into two portions along the direction of column. That is, pixels of all the rows are divided into two groups: a first pixel group 28 consisting of pixels 12 from the 1st column to the (N/2)th column and a second pixel group 29 consisting of pixels 12 from the (N/2+1)th column to the Nth column. For the first pixel group 28, a plurality of first control lines 30 are formed on the scanning substrate 15 parallel with the scanning signal lines 19. The pixel electrodes 22 of each row are connected in common to the first control lines 30 of each row. For the second pixel group 29, a plurality of second control lines 31 are formed on the scanning substrate 15 parallel with each scanning signal line 19. The pixel electrodes 22 of each row are connected in common to the second control line 31 of each row. These second control lines 31 are electrically insulated from the first control lines 30.

The data signal lines 18 are connected to a data output circuit 32, which outputs an image signal input from the external circuit to each data signal line 18 in each horizontal scanning period, as described later. The scanning signal lines 19 are connected to a scanning circuit 33, which sequentially outputs scanning signals to each of the scanning signal lines 19 during an effective display period in each horizontal scanning period, as described later. These data output circuit 32 and scanning circuit 33 are connected to a control circuit 34 realized as a micro-computer or the like, and are controlled to perform the above-mentioned operations. The drive section 14 includes these data output circuit 32, scanning circuit 33 and control circuit 34.

As shown in FIG. 3, each pixel 12 includes an equivalent capacitor 20 of the liquid crystal layer 17 sandwiched between the pixel electrode 22 and the counter electrode 24 and a storage capacitor 21. In Example 1, each pixel 12 has a first TFT 26 and a second TFT 27 respectively formed as an n-channel TFT. The pixel electrode 22 is connected to a drain of the first TFT 26 provided for each of pixel electrodes 22, and a source of the first TFT 26 is connected to a drain of the second TFT 27. A source of the second TFT 27 is connected to the data signal line 18. A gate of the first TFT 26 is connected to the scanning signal line 19. A gate of the second TFT 27 is connected to the first control line 30 or the second control line 31, depending on whether the pixel 12 belongs to the pixel group 28 or 29.

Figure 4:
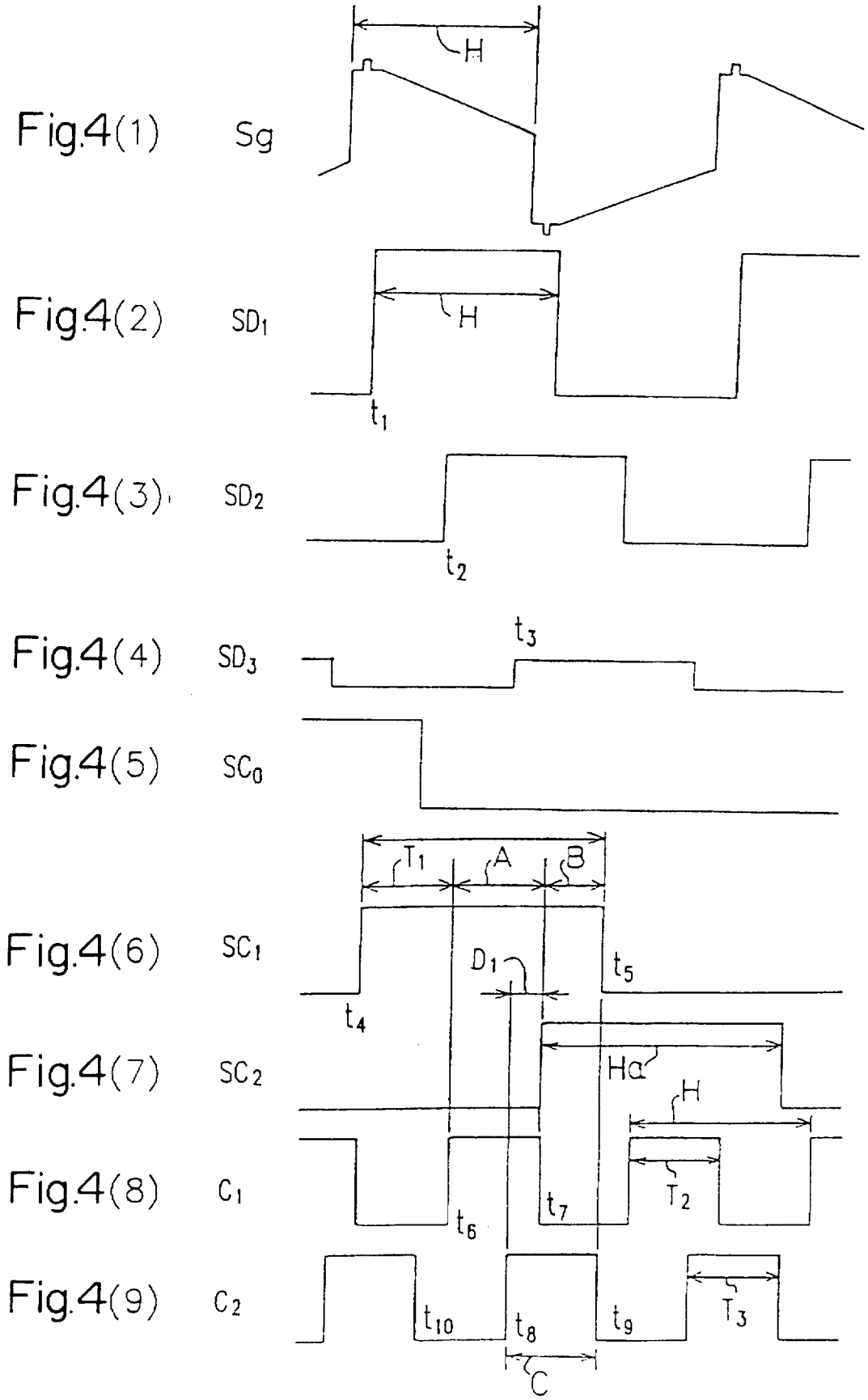
FIG. 4 is a time chart for explaining the operation of the display apparatus of the first example.

Now, the operation of the display apparatus 11 which has the above-mentioned structure will be described. FIG. 4 is a time chart for explaining the operation of the display apparatus 11. An image signal Sg shown in (1) of FIG. 4 is input into the data output circuit 32. This image signal Sg has its polarity reversed for each of the horizontal scanning periods H e.g., by an NTSC system. During the horizontal scanning period H, the data output circuit 32 samples the image signal Sg at predetermined regular intervals of time, while outputting the sampled signals to each of the data signal lines 18 sequentially along the direction of horizontal scanning. Because of this, the potential of the data signal lines 18 takes timings delayed in a sequential order as shown by (2)–(4) in FIG. 4.

With relation to the data signal lines 18 of the N columns in total, a data signal $SD_1$ of (2) of FIG. 4 represents a potential in the 1st column of data signal line 18, a data signal $SD_2$ of (3) of FIG. 4 represents a potential in the (N/2)th column of data signal line 18, and a data signal $SD_3$ of (4) of FIG. 4 represents a potential in the Nth column of data signal line 18. The data signals $SD_1$ to $SD_3$ (generally represented by a symbol of SD) of the 1st to Nth column of data signal line 18 are held only for a time period equal to the horizontal scanning period H.

In FIG. 4, (5) to (7) show waveforms of scanning signals $SC_0$, $SC_1$ and $SC_2$ (generally represented by a symbol of SC) respectively applied to the (m−1)th, mth and (m+1)th rows of the scanning signal lines 19 by the scanning circuit 33, where $1 \leqq m \leqq M-1$. In Example 1, the scanning signal SC has a special time period Ha for horizontal scanning. In FIG. 4, (8) and (9) show waveforms of a first control signal $C_1$ and a second control signal $C_2$, which are pulse signals with a cycle of H and output from the control circuit 34 to the first control line 30 and the second control line 31, respectively. The timings of the first control signal $C_1$, the second control signal $C_2$ and the scanning signal SC are determined in the following manner.

First, a falling time $t_7$ of the first control signal $C_1$ is determined so as to satisfy the below-mentioned Expression 1 relative to a time $t_1$, a time $t_2$, a time length TC and the horizontal scanning period H. The time $t_1$ is a time when the image signal Sg to be displayed in the mth row of pixels is sampled and output to the data signal line 18 of the 1st column. The time $t_2$ is a time when the image signal Sg to be displayed in the mth row of pixels 12 is sampled and output to the data signal line 18 of the (N/2)th column. TC is a time length required for charging the data signal SD applied to the data signal line 18 into the pixel electrode 22.

$$(t_2+TC) \leqq t_7 \leqq t_1+H \quad (1)$$

Expression 1 represents two conditions: the pixels 12 of the first pixel group 28 are sufficiently charged (left-hand inequality); and the TFTs 27 of the pixels 12 of the first pixel group 28 have been in an OFF state until the data signal SD to be applied to the next row of pixels 12 is output to the data signal line 18 connected to the pixels 12 of the first pixel group 28 (right-hand inequality).

Then, a rising time $t_4$ of the scanning signal $SC_1$ and a rising time $t_6$ of the first control signal $C_1$ are determined so as to satisfy the below-mentioned Expressions 2 and 3, respectively, relative to the time $t_3$ and a time $t_7$. The time $t_3$ is a time when the image signal Sg to be displayed in the mth row of pixels is sampled and outputted to the data signal line 18 of the Nth column.

$$t_4 \leqq (t_7-TC) \quad (2)$$

$$(t_3+TC-H) \leqq t_6 \leqq (t_7-TC) \quad (3)$$

Expression 2 and the right-hand inequality of Expression 3 represent a condition for sufficiently charging the mth row of pixels 12 of the first pixel group 28. The left-hand inequality of Expression 3 represents a condition of timing for starting to charge the data signal SD in the pixels 12 of the first pixel group 28 after the (m−1)th row of scanning signal $SC_0$ falls. This inequality is related also with the below-mentioned Expression 4.

In a similar manner, a falling time $t_5$ of the scanning signal $SC_1$ and a falling time $t_9$ of the second control signal $C_2$ are determined so as to satisfy the below-mentioned Expressions 4 to 6 relative to the above-mentioned time $t_2$, time $t_3$ and time $t_6$.

$$(t_3+TC) \leqq t_5 \leqq (t_6+H) \quad (4)$$

$$(t_3+TC) \leqq t_5 \leqq (t_2+H) \quad (5)$$

$$(t_3+TC) \leqq t_9 \leqq (t_5-TC+H) \quad (6)$$

Expressions 4 and 5 represent three conditions: the pixels 12 of the second pixel group 29 are sufficiently charged (left-hand inequalities of both of Expressions 4 and 5); the scanning signal SC falls before the charging of the data signal SD to the next row of pixels 12 of the first pixel group 28 is started (right-hand inequality of Expression 4); and the scanning signal SC falls by the time the data signal SD to be applied to the next row of pixels 12 is output to the data signal line 18 connected to the pixels 12 of the second pixel group 29 (right-hand inequality of Expression 5).

Expression 6 represents two conditions: the scanning signal SC falls after the pixels 12 of the first pixel group 28 are sufficiently charged (left-hand inequality); and the second control signal $C_2$ becomes a pulse signal (right-hand inequality). This inequality is related also with the below-mentioned Expression 7.

A rising time $t_8$ of the second control signal $C_2$ is determined so as to satisfy the below-mentioned Expressions 7 and 8 relative to the above-mentioned time $t_5$ and time $t_9$.

$$(t_9-H) < t_8 \leqq (t_5-TC) \quad (7)$$

$$(t_9-H) < t_8 \leqq (t_9-TC) \quad (8)$$

Expressions 7 and 8 represent two conditions: the second control signal $C_2$ becomes a pulse signal (left-hand inequalities of both of Expressions 7 and 8); and the pixels 12 of the second pixel group 29 are sufficiently charged (right-hand inequalities of both of Expressions 7 and 8).

In the case of Example 1, as apparent from the time chart of FIG. 4, it is required that the below-mentioned Expressions 9 and 10 hold among the times $t_1$, $t_2$ and $t_3$.

$$(t_2-t_1)<H/2 \quad (9)$$

$$(t_3-t_2)<H/2 \quad (10)$$

At the same time, the below-mentioned Expression 11 should be satisfied.

$$TC<H/2 \quad (11)$$

Here, utilizing Expressions 9 to 11, the times $t_4$ to $t_9$ are determined so that the above-mentioned Expressions 1 to 8 hold.

$$(t_2+TC)<(t_1+H/2+TC)<(t_1+H)=t_7 \quad (12)$$

$$(t_7-TC)>(t_7-H)=t_1=t_4 \quad (13)$$

$$(t_3+TC-H)<(t_3-H/2)<(t_1+H/2)=t_6<(t_7-H/2)<(t_7-TC) \quad (14)$$

$$(t_3+TC)<(t_3+H/2)=t_5<(t_2+H)<(t_1+3H/2)=(t_6+H) \quad (15)$$

$$(t_3+TC)<(t_3+H/2)=t_9<(t_3+H)<(t_5-TC+H) \quad (16)$$

$$(t_9-H)=(t_3-H/2)<t_3=t_8=(t_5-H/2)=(t_9-H/2)<(t_5-TC)=(t_9-TC) \quad (17)$$

Expression 12 is an example of setting of the time $t_7$ so as to satisfy Expression 1. Expression 13 is an example of setting of the time $t_4$ so as to satisfy Expression 2. Expression 14 is an example of setting of the time $t_6$ so as to satisfy Expression 3. Expression 15 is an example of setting of the time $t_5$ so as to satisfy Expressions 4 and 5. Expression 16 is an example of setting of the time $t_9$ so as to satisfy Expression 6. Expression 17 is an example of setting of the time $t_9$ so as to satisfy Expressions 7 and 8.

As a result, in the above exemplary setting, a high level time period $T_2$ of the first control signal $C_1$ and a high level time period $T_3$ of the second control signal $C_2$ become equal to each other, and the following Expression 18 holds:

$$T_2=T_3=H/2 \quad (18)$$

The display operation based on the timings determined as above will be described in detail, using the case of conducting a display in the mth row of pixels as an example.

The scanning circuit 33 outputs to the mth row of scanning signal line 19 the scanning signal $SC_1$ whose level is changed from a LOW level to a HIGH level at the time $t_4$. By means of this scanning signal $SC_1$, the first TFTs 26 in the first and second pixel groups 28 and 29 are turned ON. Meanwhile, the first control signal $C_1$ is in the OFF state and thus no data signal is supplied to the pixel electrode 22 of the first pixel group 28.

A time period $T_1$ from the time $t_4$ to the time $t_6$ will be explained. The time $t_6$ is the first rising time of the first control signal $C_1$ after the time $t_4$. The second control signal $C_2$ is at a HIGH level during a time period from the time $t_4$ to a time $t_{10}$. The time $t_{10}$ is the first falling timing of the second control signal $C_2$ after the time $t_4$, as defined by the following Expression 19:

$$t_{10}=t_9-H \quad (19)$$

During this time period from the time $t_4$ to the time $t_{10}$, the image signal Sg to be displayed in the (m−1)th row of pixels is output from the data output circuit 32 to the data signal line 18 corresponding to the second pixel group 29. Thereafter, during a time period from the time $t_{10}$ to the time $t_6$, the data signal SD is not applied to the pixel electrode 22 of the second pixel group 29, since the second control signal $C_2$ is at a LOW level. Accordingly, in the time period $T_1$ from the time $t_4$ to the time $t_6$, the data signal SD in accordance with an actual display is not supplied to the mth row of pixel electrode 22 of the display section 13, though the scanning signal SC to the mth row of scanning signal line 19 is at a HIGH level.

At the time $t_6$, the level of the first control signal $C_1$ becomes HIGH level and the second TFT 27 is turned ON. Then, the image signal Sg to be displayed on the mth row of pixels 12 has been output to the data signal line 18 which corresponds to the first pixel group 28, and the data signal SD in accordance with an actual display is applied to the pixel electrode 22 of the first pixel group 28, while the data signal SD is not applied to the pixel electrode 22 of the second pixel group 29. Then, at the time $t_7$ after a time period A (equal to the time period $T_2$) from the time $t_6$, the level of the first control signal $C_1$ is changed to a LOW level and the second TFT 27 is turned OFF. Thereafter, during a time period including a time period B which terminates by the change of the level of the scanning signal $SC_1$ to a LOW level, the pixel electrode 22 holds the data signal SD by means of the liquid crystal layer 17 between the pixel electrode 22 and the counter electrode 24.

On the other hand, at the time $t_8$, the second control signal $C_2$ rises, the level of the second control signal $C_2$ becomes a HIGH level, and the second TFTs 27 of the second pixel group 29 are turned ON. As shown by (2)–(4) in FIG. 4, at this time $t_8$, the image signal Sg to be displayed in the mth row of pixel electrodes 22 is output also to the data signal line 18 which corresponds to the second pixel group 29. Thus, the data signal SD in accordance with an actual display is applied to the pixel electrodes 22 of the second pixel group 29.

Then, at the time $t_9$ after a time period C (equal to the time length $T_3$) from the time $t_8$, the level of the scanning signal $SC_1$ is changed to a LOW level. As a result, the first TFTs 26 of the first and second pixel groups 28 and 29 as well as the second TFTs 27 of the second pixel group 29 are in the OFF state. In a time period following this until the level of signal of the mth row of the scanning signal line 19 rises to a HIGH level, the pixel electrodes 22 of the first and second pixel groups 28 and 29 in the mth row hold the written data.

Here, at the time $t_7$, the level of the first control signal $C_1$ is changed to a LOW level, and the scanning circuit 33 outputs a scanning signal $SC_2$ to the (m+1)th scanning signal line 19 which is to be scanned next. In the following process, the signals are respectively applied to the (m+1)th scanning signal line 19 as described above. That is, in the scanning signal $SC_2$ to the (m+1)th scanning signal line 19, until the time period $T_1$ elapses since the rising timing thereof, the data signal SD in accordance with an actual display is not applied in any of the pixel electrodes 22 of the (m+1)th row of pixels 12, similarly to the case of the mth scanning signal line 19.

Accordingly, writing of the data signal SD to the pixel electrodes 22 of the second pixel group 29 among the N pixel electrodes 22 connected to the mth scanning signal line 19 is conducted during the horizontal scanning periods for the mth and the (m+1)th scanning signal lines 19. This makes it possible to set the time periods A and C so as to be long enough to completely write the data signal SD to the pixels 12. Therefore, a time length for charging the data signal SD applied to the data signal line 18 into the pixel electrode 22 is assured for every pixel electrode 22, even if the density of the pixel 12 of the display apparatus 11 is high.

This allows display irregularities in a display panel to be eliminated, leading to much improvement of the quality of a display image.

In addition, according to Example 1, the improvement of a display image is achieved only by forming the first and second control signal lines 30 and 31 with a modified patterning mask. Accordingly, a display apparatus with a simple structure is realized without increasing the number of components of the apparatus.

In this Example 1, the method of dividing the display section 13 is not limited to such a way of classification that the first pixel group 28 and the second pixel group 29 contain the same number of columns of pixels 12. The first and the second TFTs 26 and 27 mentioned above as n-channel TFTs may be p-channel TFTs instead. In the case of using p-channel TFTs, polarities of the scanning signal SC to each scanning signal line 19, the first control signal $C_1$ to the first control line 30 and the second control signal $C_2$ to the second control line 31 are reversed to the case of above-mentioned Example 1. Additionally, according to Example 1 as described above, the first control signal lines 30 and the second control signal lines 31 are connected collectively for the first pixel group 28 and the second pixel group 29, respectively, to be driven. However, the control signal lines 30 and 31 within the first pixel group 28 and the second pixel group 29 may be connected independently for each row further to the control circuit 34, so that each line of the control signal lines 30 and 31 may be driven individually.

In the above description of Example 1, the display apparatus 11 using the TFTs 26 and 27 as a switching element for the pixel electrode 22 is shown. A crystal Silicon (Si) or an amorphous Si may be used for these TFTs 26 and 27. In addition, the same effects as described above are obtained by using a substrate made of monocrystal Si as the scanning substrate 15 and forming the drive section 14 of Example 1 on the Si-substrate.

EXAMPLE 2

Figure 5:
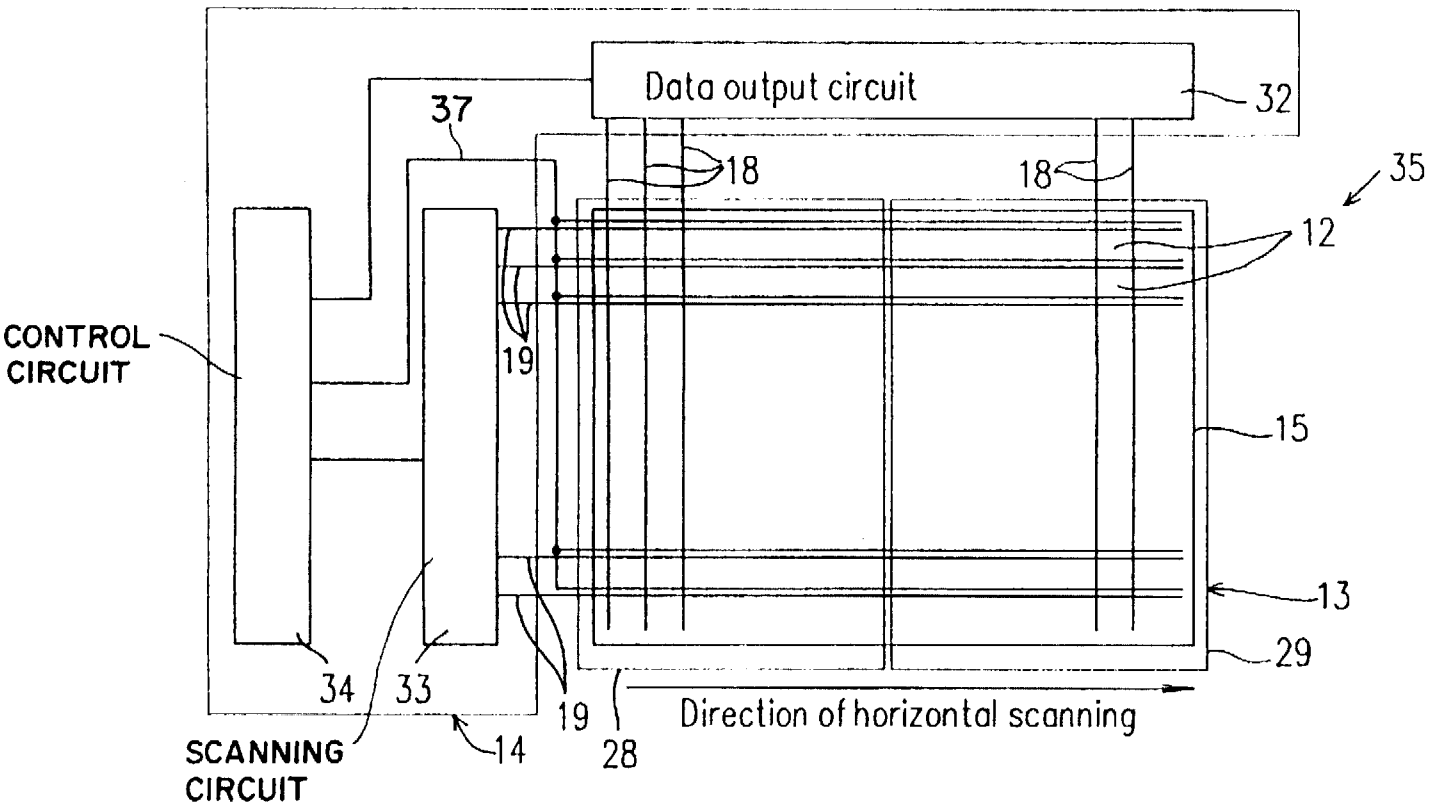
FIG. 5 is a block diagram showing a display apparatus of a second example of the invention.
Figure 6:
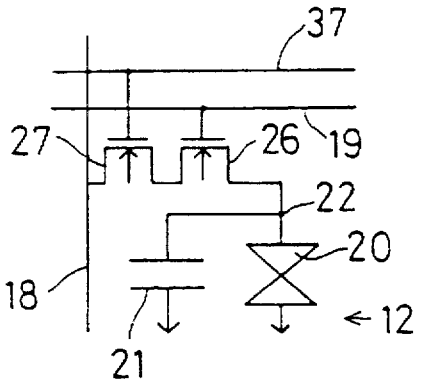
FIG. 6 is an electric equivalent circuit diagram of the vicinity of a pixel of a first pixel group of the display apparatus of the second example.

FIGS. 5 through 8 show Example 2 of the present invention. FIG. 5 is a block diagram showing a display apparatus 35 of Example 2 of the present invention. FIG. 6 is an electric equivalent circuit diagram of the vicinity of each of the pixels 12 of the first pixel group 28 of the display apparatus 35 of Example 2. FIG. 7 is an electric equivalent circuit diagram of the vicinity of each of the pixels 12 of the second pixel group 29 of Example 2. FIG. 8 is a time chart for describing the operation of the display apparatus 35 of Example 2. Example 2 of the invention will be described with reference to FIG. 2 in addition to these FIGS. 5 through 8.

Since this Example 2 is similar to Example 1, the same components as those in Example 1 are marked with the same reference numerals as those in FIGS. 1 to 4. Example 2 is characterized by a plurality of control lines 37 provided for all the rows of pixel electrodes 22. Each of the control lines 37 is connected to the one row of pixel electrodes 22, for both the first pixel group 28 and the second pixel group 29 of the display section 13 divided similarly to Example 1. The control lines 37 of the respective rows are connected to the control circuit 34 in common.

Similar to Example 1, each of the pixels 12 of Example 2 includes an equivalent capacitor 20 of the liquid crystal layer 17 sandwiched between the pixel electrode 22 and the counter electrode 24 and a storage capacitor 21. In Example 2, each of pixels 12 of the first pixel group 28 has a first TFT 26 and a second TFT 27 respectively formed as an n-channel TFT, as shown by FIG. 6. The pixel electrode 22 is connected to a drain of the first TFT 26 provided for each of pixel electrodes 22, and a source of the first TFT 26 is connected to a drain of the second TFT 27. A source of the second TFT 27 is connected to the data signal line 18. A gate of the first TFT 26 is connected to the scanning signal line 19. A gate of the second TFT 27 is connected to the control line 37.

Figure 7A:
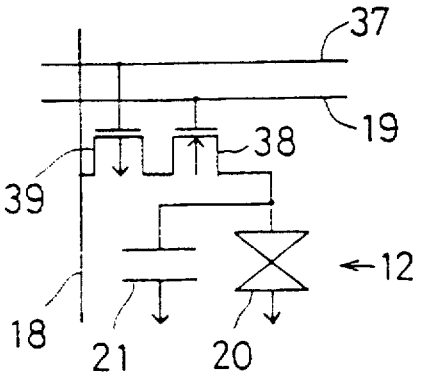
FIGS. 7A to 7C are electric equivalent circuit diagrams of the vicinity of a pixel of a second pixel group of the second example.
Figure 7B:
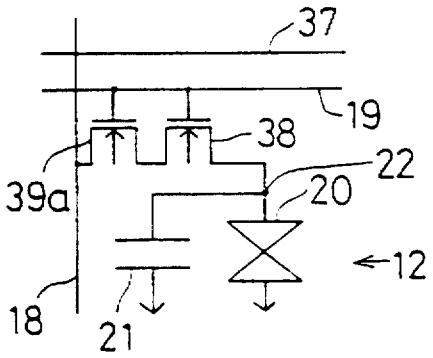
Figure 7C:
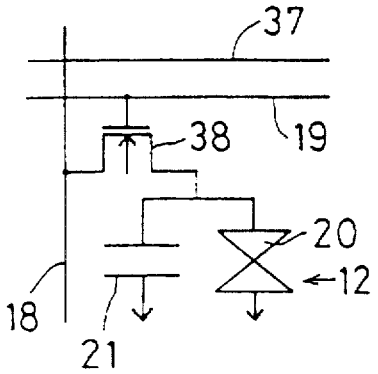

As shown by FIG. 7A, a first TFT 38 formed as an n-channel TFT and a second TFT 39 formed as a p-channel TFT are serially connected in each of the pixels 12 of the second pixel group 29. The pixel electrode 22 is connected to a drain of the first TFT 38 provided for each of pixel electrodes 22, and a source of the first TFT 38 is connected to a drain of the second TFT 39. A source of the second TFT 39 is connected to the data signal line 18. A gate of the first TFT 38 is connected to the scanning signal line 19. A gate of the second TFT 39 is connected to the control line 37. FIGS. 7B and 7C respectively show other exemplary structures of a switching element for each of the pixels 12 of the second pixel group 29.

FIG. 8 is a time chart for explaining the operation of the display apparatus 35. The operation of the display apparatus 35 which has the above-mentioned structure will be described, with reference also to FIG. 8.

An image signal Sg shown by (1) of FIG. 8 is inputted into the data output circuit 32. This image signal Sg has its polarity reversed for each of the horizontal scanning periods H. During the horizontal scanning period H, the data output circuit 32 samples the image signal Sg at predetermined regular intervals of time, while outputting the sampled signals (i.e., data signals SD) to each of the data signal lines 18 sequentially along the direction of horizontal scanning. Because of this, the potential of the data signal lines 18 takes timings delayed in a sequential order as shown by (2)–(4) in FIG. 8.

A data signal $SD_1$ of (2) of FIG. 8 represents a potential in the 1st column of data signal line 18, a data signal $SD_2$ of (3) of FIG. 8 represents a potential in the (N/2)th column of data signal line 18 and a data signal $SD_3$ of (4) of FIG. 8 represents a potential in the Nth column of data signal line 18. The data signals $SD_1$ to $SD_3$ of the 1st to Nth column of data signal line 18 are held only for a time period equal to the horizontal scanning period H.

In FIG. 8, (5) to (7) show waveforms of scanning signals $SC_0$, $SC_1$ and $SC_2$ respectively applied to the (m−1)th, mth and (m+1)th rows of the scanning signal lines 19 by the scanning circuit 33, where $1 \leqq m \leqq M-1$. In Example 2, the scanning signal SC has a special period Hb for horizontal scanning.

In FIG. 8, (8) shows the waveform of a control signal C, a pulse signal with a cycle of H and outputted from the control circuit 34 to the control line 37. The timings of this control signal C and the scanning signal SC are determined in the following manner.

Referring to FIG. 8, first, a rising time $t_{17}$ of the control signal C is determined so as to satisfy the below-mentioned Expression 20 relative to a time $t_{11}$, a time $t_{12}$, a time length TC, and the horizontal scanning period H. The time $t_{11}$ is a time when the image signal Sg to be displayed in the mth row of pixels 12 is sampled and outputted to the data signal line 18 of the 1st column. The time $t_{12}$ is a time when the image signal Sg to be displayed in the mth row of pixels 12 is sampled and outputted to the data signal line 18 of the (N/2)th column. TC is a time length required for charging the data signal SD applied to the data signal line 18 into the pixel electrode 22.

$$(t_{12}+TC)\leqq t_{17}\leqq t_{11}+H \quad (20)$$

Expression 20 represents two conditions: the pixels 12 of the first pixel group 28 are sufficiently charged (left-hand inequality); and the TFTs 27 of the pixels 12 of the first pixel group 28 have been in an OFF state until the data signal SD to be applied to the next row of pixels 12 is output to the data signal line 18 connected to the pixels 12 of the first pixel group 28 (right-hand inequality).

Then, a rising time $t_{14}$ of the scanning signal $SC_1$ and a rising time $t_{16}$ of the control signal C are determined so as to satisfy the below-mentioned Expressions 21 and 22, respectively, relative to the time $t_{13}$ and a time $t_{17}$. The time $t_{13}$ is a time when the image signal Sg to be displayed in the mth row of pixels 12 is sampled and outputted to the data signal line 18 of the Nth column.

$$t_{14}\leqq(t_{17}-TC) \quad (21)$$

$$(t_{13}+TC-H)\leqq t_{16}\leqq(t_{17}-TC) \quad (22)$$

Expression 21 and the right-hand inequality of Expression 22 represent a condition for sufficiently charging the mth row of pixels 12 of the first pixel group 28. The left-hand inequality of Expression 22 represents a condition of timing for starting to charge the data signal SD in the pixels 12 of the first pixel group 28 after the (m−1)th row of scanning signal $SC_0$ falls. This inequality is related also with the below-mentioned Expression 23.

In a similar manner, a falling time $t_{15}$ of the scanning signal $SC_1$ is determined so as to satisfy the below-mentioned Expressions 23 and 24 relative to the above-mentioned time $t_{12}$, time $t_{13}$ and time $t_{16}$.

$$(t_{13}+TC)\leqq t_{15}\leqq(t_{16}+H) \quad (23)$$

$$(t_{13}+TC)\leqq t_{15}\leqq(t_{12}+H) \quad (24)$$

Expressions 23 and 24 represent three conditions: the pixels 12 of the second pixel group 29 are sufficiently charged (left-hand inequalities of both of Expressions 23 and 24); the scanning signal SC falls before the charging of the data signal SD to the next row of pixels 12 of the first pixel group 28 is started (right-hand inequality of Expression 23); and the scanning signal SC falls by the time the data signal SD to be applied to the next row of pixels 12 is output to the data signal line 18 connected to the pixels 12 of the second pixel group 29 (right-hand inequality of Expression 24).

In the case of Example 2, as apparent from the time chart shown by FIG. 8, it is required that the below-mentioned Expressions 25 and 26 hold among the times $t_{11}$, $t_{12}$ and $t_{13}$.

$$(t_{12}-t_{11})<H/2 \quad (25)$$

$$(t_{13}-t_{12})<H/2 \quad (26)$$

At the same time, the below-mentioned Expression 27 should be satisfied.

$$TC<H/2 \quad (27)$$

Utilizing the above-mentioned Expressions 25 to 27, the times $t_{14}$ to $t_{17}$ are determined so as to satisfy the Expressions 20 to 24.

$$(t_{12}+TC)<(t_{11}+H/2+TC)<(t_{11}+H)=t_{17} \quad (28)$$

$$(t_{17}-TC)>(t_{17}-H)=t_{11}=t_{14} \quad (29)$$

$$(t_{13}+TC-H)<(t_{13}-H/2)<(t_{11}+H/2)=t_{16}<(t_{17}-H/2)<(t_{17}-TC) \quad (30)$$

$$(t_{13}+TC)<(t_{13}+H/2)=t_{15}<(t_{12}+H)<(t_{11}+3H/2)=(t_{16}+H) \quad (31)$$

Expression 28 is an example of setting of the time $t_{17}$ so as to satisfy Expression 20. Expression 29 is an example of setting of the time $t_{14}$ so as to satisfy Expression 21. Expression 30 is an example of setting of the time $t_{16}$ so as to satisfy Expression 22. Expression 31 is an example of setting of the time $t_{15}$ so as to satisfy Expressions 23 and 24.

As a result, in the above exemplary setting, a high level time period $T_2$ of the control signal C becomes as follows:

$$T_2=H/2 \quad (32)$$

The display operation based on the timings determined as above will be described in detail. The case of conducting a display in the mth row of pixels 12 will be used as an example.

The control signal C has been output from the control circuit 34 to the control line 37, as shown by (8) of FIG. 8. The scanning circuit 33 outputs to the mth row of scanning signal line 19 the scanning signal $SC_1$ whose level is changed from a LOW level to a HIGH level at the time $t_{14}$, as shown by (6) of FIG. 8.

By means of this scanning signal $SC_1$, the first TFTs 26 and 38 in the first and second pixel groups 28 and 29 are turned ON. The control signal C is at a LOW level in a time period $T_{11}$ from the time $t_{14}$ to the time $t_{16}$. The time $t_{16}$ is the first rising time of the control signal C after the time $t_{14}$. In this time period $T_{11}$, the second TFT 27 of the first pixel group 28 is turned OFF, and the second TFT 39 of the second pixel group 29 is turned ON. For this reason, the data signal SD is not applied to the pixel electrode 22 of the first pixel group 28. In addition, to the data signal line 18 which corresponds to the second pixel group 29, the image signal Sg to be displayed in the (m−1)th row of pixels 12 has been output. Because of this, the data signal SD to be displayed in the mth row of pixels 12 is not applied to the pixel electrode 22 of the second pixel group 29. Accordingly, during the time period $T_{11}$ from the time $t_1$i to the time $t_{12}$, the data signal SD in accordance with an actual display is not supplied to the mth row of pixel electrodes 22 of the display section 13, though the scanning signal $SC_1$ to the mth row of scanning signal line 19 is at a HIGH level.

At the time $t_{16}$, the level of the control signal C becomes a HIGH level, the second TFT 27 of the first pixel group 28 is turned ON, and the second TFT 39 of the second pixel group 29 is turned OFF. Then, the image signal Sg to be displayed in the mth row of pixels 12 has been output to the data signal line 18 which corresponds to the first pixel group 28. Thus the data signal SD in accordance with an actual display is applied to the pixel electrode 22 of the second pixel group 29, while the data signal SD is not applied to the pixel electrode 22 of the second pixel group 29.

At the time $t_{17}$ after the time period Al (equal to the time period $T_2$) from the time $t_{16}$, the level of the control signal C is changed to a LOW level, and thereby the second TFT 27 of the first pixel group 28 is turned OFF. Thereafter, in a time period $B_1$ until the time $t_{15}$ at which the level of the scanning signal $SC_1$ is changed to a LOW level, the pixel electrode 22 of the first pixel group 28 holds the data signal SD by means of the liquid crystal layer 17 between the pixel electrode 22 and the counter electrode 24. On the other hand, in this time period $B_1$, the second TFT 39 of the second pixel group 29 is turned ON, and the image signal Sg to be displayed in the mth row of pixels 12 has been already output to the data signal line 18 which corresponds to the second pixel group 29. Thus the data signal SD in accordance with an actual display is applied to the pixel electrode 22 of the second pixel group 29.

At the time $t_{15}$, the level of the scanning signal $SC_1$ is changed to a LOW level. Thereby, the first TFT 26 of the first pixel group 28 and the first TFT 38 of the second pixel group 29 are in the OFF state. In a time period following the time $t_{15}$ until the level of the scanning signal $SC_1$ of the mth row of the scanning signal line 19 rises to a HIGH level, the pixel electrodes 22 in the mth row of the first and second pixel groups 28 and 29 hold the written data.

Here, at the time $t_{17}$, the level of the control signal C is changed to a LOW level, and the scanning circuit 33 outputs a scanning signal $SC_2$ to the (m+1)th row of scanning signal line 19 which is to be scanned next. Subsequently, the scanning signal SC is applied to the (m+1)th row of scanning signal line 19 as described above. That is, in the scanning signal $SC_2$ to the (m+1)th row of scanning signal line 19, an operation for display in the (m+1)th row of the scanning signal line 19 is performed neither in the first pixel group 28 nor in the second pixel group 29 in a time period from the rising timing thereof to the lapse of the time period $T_{11}$. In this way, the scanning signals SC are applied to all the scanning signal lines 19.

The case where the switching element of the pixel 12 of the second pixel group 29 has a structure as shown in FIG. 7B or FIG. 7C will be described hereinafter. As shown by FIG. 7B, in the case of using a second TFT **39*a* which is an n-channel TFT, a gate of the second TFT 39*a* is connected to the scanning signal line 19. As shown by FIG. 7C, in the case of using a single n-channel TFT 38, a gate of the TFT 38 is connected to the scanning signal line 19. The structures shown by FIGS. 7B and 7C** are electrically equivalent to each other, and the display operations thereof are the same.

The display operation in this case is similar to the display operation of Example 2. The display operation for the first pixel group 28 is the same as that of Example 2. Therefore, only the operation for the second pixel group 29 will be described hereinafter. When the level of the scanning signal $SC_1$ becomes a HIGH level at the time $t_{14}$, the TFTs **39*a* and 38 are turned ON. During a time period from the time $t_{11}$ to $t_{15}$, the image signal Sg to be displayed on the (m−1)th row of pixels 12 is output to the Nth column of data signal line 18. Because of this, the data signal SD to be displayed in the mth row of pixels 12 is not applied to the data signal line 18 of the second pixel group 29**.

At the time $t_{13}$, the image signal Sg to be displayed in the mth row of pixels 12 is output to the Nth column of the data signal line 18. Because of this, the data signal $SD_3$ is applied to the pixel electrode 22 of the second pixel group 29 at least in a time period from the time $t_{13}$ to the time $t_{15}$ of the falling time of the scanning signal $SC_1$.

Thereafter, the level of scanning signal $SC_1$ is changed to a LOW level at the time $t_{15}$, and thereby the first TFTs 26 and 38 of the first and second pixel groups 28 and 29 are in the OFF state. Subsequently, the pixel electrodes 22 of the first and second pixel groups 28 and 29 in the mth row hold the written data until the level of the signal of the mth row of scanning signal line 19 rises to a HIGH level. In a process following this, the signals are respectively applied to the (m+1)th scanning signal line 19 as described above and display operation is performed.

The same effects as those of aforesaid Example are obtained by the display apparatus 35 of Example 2 having thus constructed switching elements for the second pixel group 29.

In addition, the method of dividing the display section 13 is not limited to such a way of classification that the first pixel group 28 and the second pixel group 29 contain the same number of columns of pixels 12. The control line 37 of each row may be controlled individually for each row. Furthermore, the converse configuration of TFT conductivity may be possible, though the TFTs 26, 27, 38 and **39*a* are formed as n-channel TFTs and the TFT 39 as a p-channel TFT in Example 2. In such a case, polarities of the scanning signal SC to each scanning signal line 19 and the control signal C to the control line 37 are reversed to the case of this Example 2. Moreover, a monocrystal Si or an amorphous Si may be used for a switching element for the pixel electrode 22 exemplified by the display apparatus 35 using the TFTs 26, 27, 38, 39 and 39*a* in Example 2. The same effects as those of the above-mentioned Example are obtained by using a substrate made of monocrystal Si as the scanning substrate 15 and forming the drive section 14** of Example 1 on the Si-substrate.

EXAMPLE 3

Figure 9:
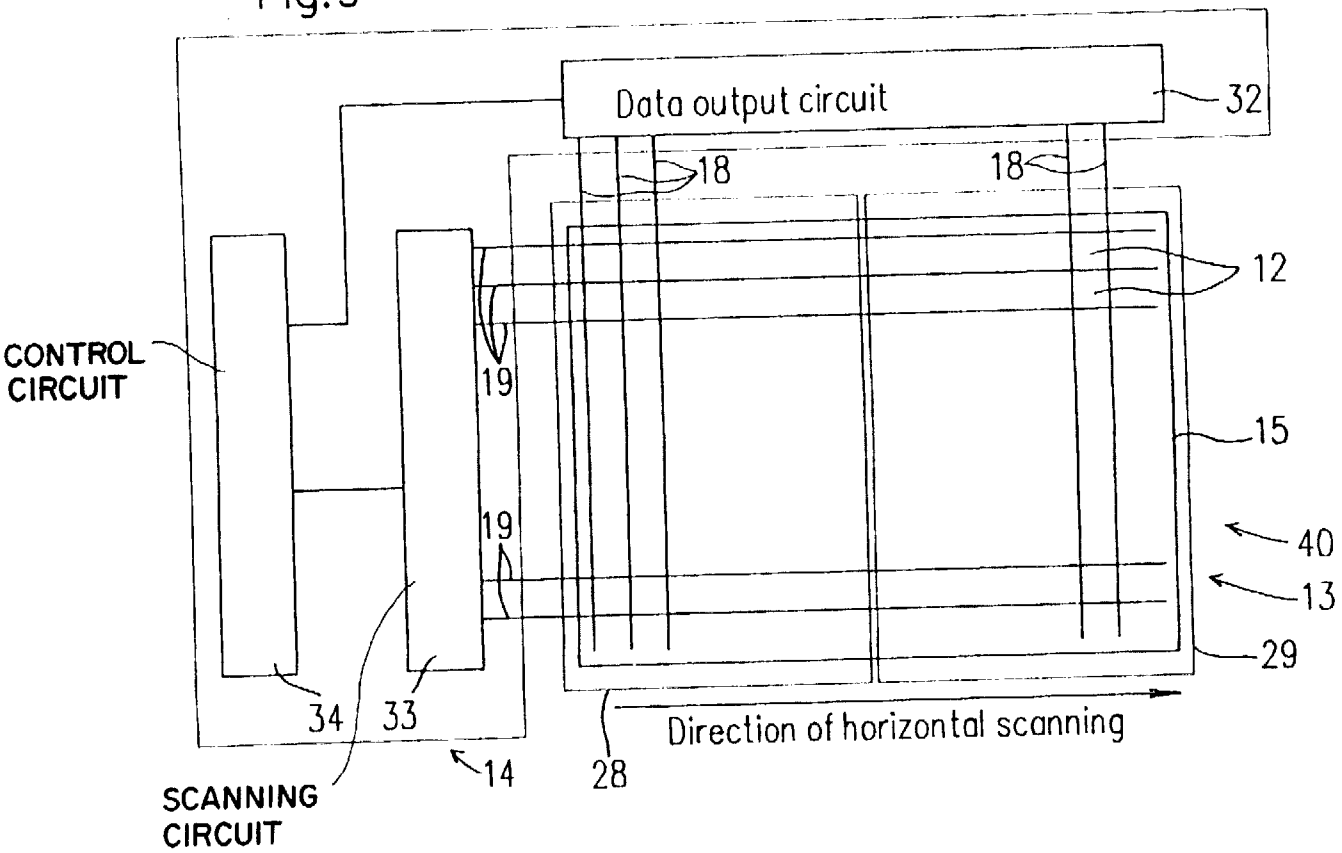
FIG. 9 is a block diagram showing a display apparatus of a third example of the invention.
Figure 10:
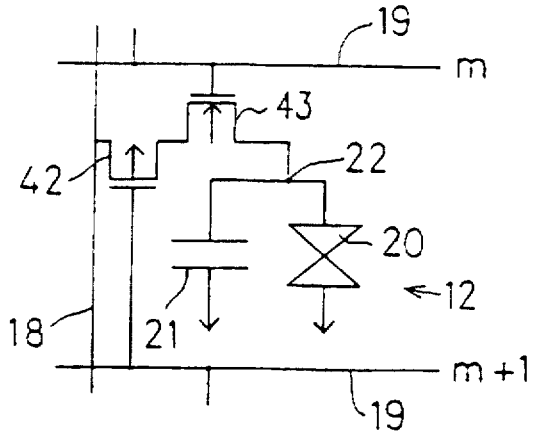
FIG. 10 is an electric equivalent circuit diagram of the vicinity of a pixel of a first pixel group of the display apparats of the third example.

FIG. 9 is a block diagram showing a display apparatus 40 of Example 3 of the present invention. FIG. 10 is a block diagram showing an electric equivalent circuit in the vicinity of each of pixels 12 of the first pixel group 28 of the display apparatus 40. FIG. 11 is an electric equivalent circuit diagram of the vicinity of each of the pixels 12 of the second pixel group 29 of Example 3. FIG. 12 is a time chart for describing the operation of the display apparatus 40 of this Example 3. FIG. 2 as well as FIGS. 9 to 12 will also be referred to in the following description of Example 3.

Since this Example 3 is similar to Examples 1 and 2, the same components as those of Examples 1 and 2 are marked with the same reference numerals as those in FIGS. 1 to 8. Example 3 is characterized by the structure of the display apparatus 40 in which the display section 13 is divided into the first pixel group 28 and the second pixel group 29, similarly to Examples 1 and 2, without the control lines 30, 31 and 37.

In this Example 3, a plurality of pixels 12 which correspond to the mth row of scanning signal line 19 in the first and second pixel groups 28 and 29 are respectively connected to the scanning signal line 19, where $1 \leqq m \leqq M-1$. For each of pixels 12 of the first pixel group 28, a first TFT 41 formed as an n-channel TFT and a second TFT 42 formed as a p-channel TFT are provided, as shown by FIG. 10. A gate of the first TFT 41 is connected to the mth row of scanning signal line 19, and a gate of the second TFT 42 is connected to the (m+1)th row of scanning signal line 19.

Figure 11A:
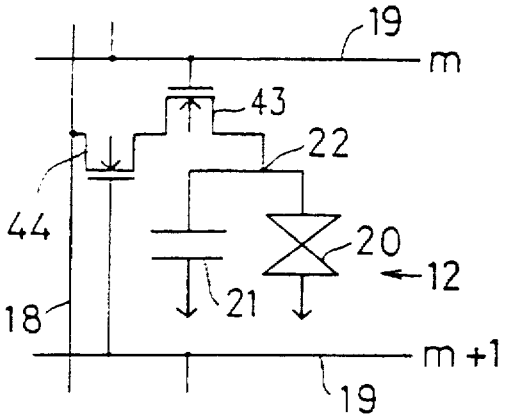
FIGS. 11A to 11C are electric equivalent circuit diagrams of the vicinity of a pixel of a second pixel group of the third example.
Figure 11B:
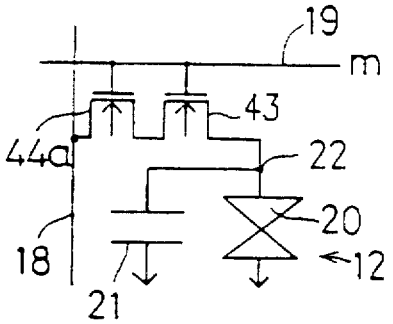
Figure 11C:
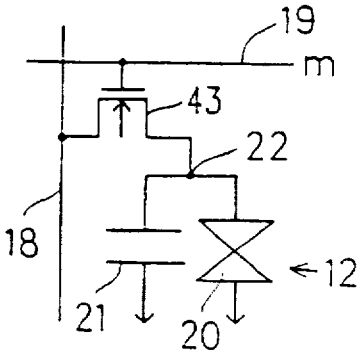
Figure 12:
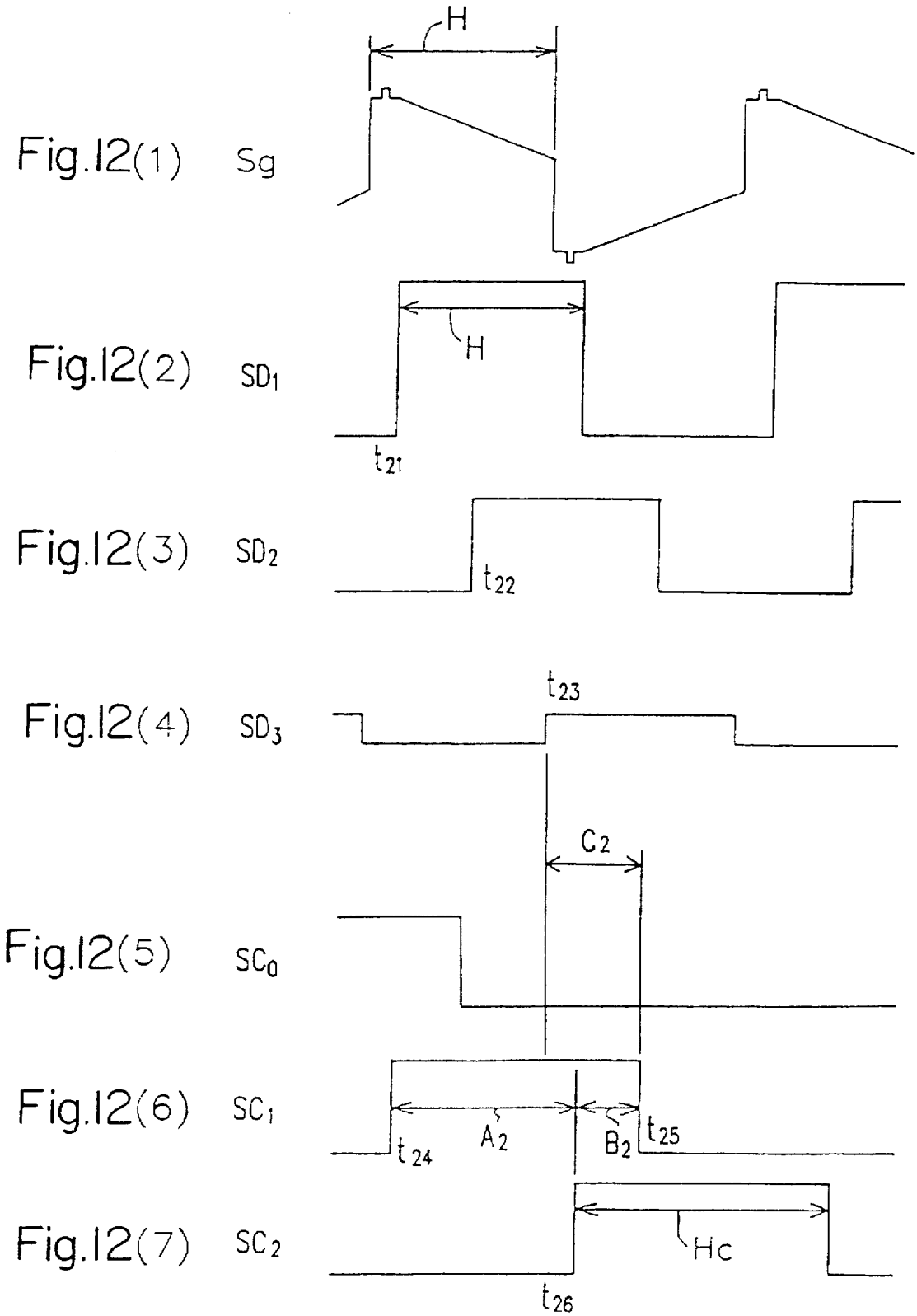
FIG. 12 is a time chart for explaining the operation of the display apparatus of the third example.
Figure 13:
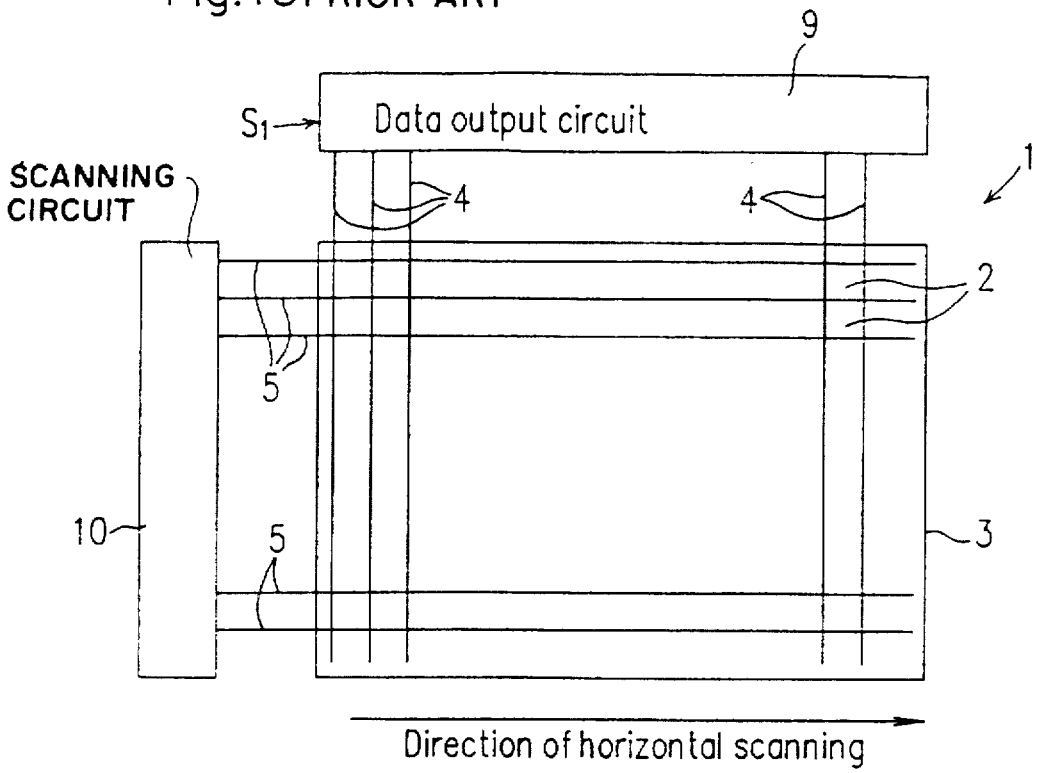
Fig.13 PRIOR ART
FIG. 13 is a block diagram showing a conventional active matrix type liquid crystal display apparatus using a TFT.
Figure 14:
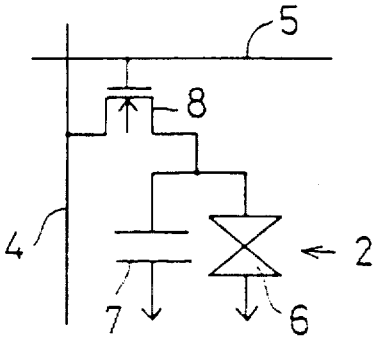
Fig.14 PRIOR ART
FIG. 14 is an electric equivalent circuit diagram of a pixel of the display apparatus shown in FIG. 13.

As shown by FIG. 11A, a first TFT 43 and a second TFT 44 respectively formed as an n-channel TFT are provided for each of pixels 12 of the second pixel group 29. A gate of the first TFT 43 is connected to the mth row of scanning signal line 19. A gate of the second TFT 44 is connected to the (m+1)th row of scanning signal line 19. FIGS. 11B and 11C respectively show other exemplary switching elements for each of the pixels 12 of the second pixel group 29.

FIG. 12 is a time chart for explaining the operation of the display apparatus 40. The operation of the display apparatus 40 which has the above-mentioned structure will be described, with reference also to FIG. 12.

An image signal Sg shown in (1) of FIG. 12 is input into the data output circuit 32. During the horizontal scanning period H, the data output circuit 32 samples the image signal Sg at predetermined regular intervals of time, while outputting the sampled signals (i.e., data signals SD) to each of the data signal lines 18 sequentially along the direction of horizontal scanning. Hereby, the potential of the data signal lines 18 takes timings delayed in a sequential order as shown by (2)–(4) of FIG. 12.

A data signal $SD_1$ of (2) of FIG. 12 represents a potential in the 1st column of data signal line 18, a data signal $SD_2$ of (3) of FIG. 12 represents a potential in the (N/2)th column of data signal line 18 and a data signal $SD_3$ of (4) of FIG. 12 represents a potential in the Nth column of data signal line 18. In the data signals SD of the 1st to the Nth column of the data signal line 18, the data signals $SD_1$ to $SD_3$ are held only for a time period equal to the horizontal scanning period H.

In FIG. 12, (5) to (7) show waveforms of scanning signals $SC_0$, $SC_1$ and $SC_2$ respectively applied to the (m−1)th, mth and (m+1)th rows of the scanning signal lines 19 by the scanning circuit 33. In Example 3, the scanning signal SC has a special period Hc for horizontal scanning.

The timing of this scanning signal SC is determined in the following manner.

First, a falling time $t_{25}$ of the scanning signal $SC_1$ is determined so as to satisfy the below-mentioned Expression 33 relative to a time $t_{22}$, a time $t_{23}$, a time length TC and the horizontal scanning period H. The time $t_{22}$ is a time when the image signal Sg to be displayed in the mth row of pixels 12 is sampled and output to the data signal line 18 of the (N/2)th column. The time $t_{23}$ is a time when the image signal Sg to be displayed in the mth row of pixels 12 is sampled and output to the data signal line 18 of the Nth column. TC is a time length required for charging the data signal SD applied to the data signal line 18 into the pixel electrode 22.

$$(t_{23}+TC)\leqq t_{25}\leqq(t_{22}+H) \tag{33}$$

Expression 33 represents two conditions: the scanning signal SC falls after the pixels 12 of the second pixel group 29 are sufficiently charged (left-hand inequality); and the scanning signal SC falls by the time the data signal SD to be applied to the next row of pixels 12 is output to the data signal line 18 connected to the pixels 12 of the second pixel group 29 (right-hand inequality).

Then, a rising time $t_{24}$ of the scanning signal $SC_1$ is determined so as to satisfy the below-mentioned Expressions 34 and 35, relative to the time $t_{21}$, the time $t_{22}$ and the time $t_{25}$.

$$(t_{22}+TC-H)\leqq t_{24}\leqq t_{21} \tag{34}$$

$$(t_{22}+TC-H)\leqq t_{24}\leqq(t_{25}-TC-H) \tag{35}$$

Expressions 34 and 35 represent two conditions: the pixels 12 of the first pixel group 28 are sufficiently charged (left-hand inequalities); and the TFTs 41 of the pixels 12 of the first pixel group 28 have been in an OFF state until the data signal SD to be applied to the next row of pixels 12 is output to the data signal line 18 connected to the pixels 12 of the first pixel group 28 (right-hand inequalities).

In the case of Example 3, as apparent from the time chart shown by FIG. 12, it is required that the below-mentioned Expressions 36 and 37 hold.

$$(t_{22}-t_{21})<H/2 \tag{36}$$

$$(t_{23}-t_{22})<H/2 \tag{37}$$

At the same time, the below-mentioned Expression 38 should be satisfied.

$$TC<H/2 \tag{38}$$

Utilizing the above-mentioned Expressions 33 to 35, the times $t_{24}$ and $t_{25}$ are determined so as to satisfy the above-mentioned Expressions 36 to 38.

$$(t_{23}+TC)<(t_{23}+H/2)<(t_{22}+H)=t_{25} \tag{39}$$

$$(t_{22}+TC-H)<(t_{22}+H/2-H)=(t_{22}-H/2)=t_{24}=(t_{25}-H/2-H)<(t_{25}-TC-H) \tag{40}$$

Expression 39 is an example of setting of the time $t_{25}$ so as to satisfy Expression 33. Expression 40 is an example of setting of the time $t_{24}$ so as to satisfy Expression 35. In the above setting of Expression 40, Expression 41 holds.

$$t_{24}=(t_{22}-H/2)<t_{21} \tag{41}$$

The display operation based on the timings determined as above will be described in detail, using the case of conducting display in the mth row of pixels 12 as an example. As shown by (6) and (7) in FIG. 12, the scanning circuit 33 outputs the scanning signal $SC_1$ and the scanning signal $SC_2$ to the scanning signal lines 19 of the mth and (m+1)th rows, respectively. At the time $t_{24}$, the level of the scanning signal $SC_1$ is changed from a LOW level to a HIGH level, and the level of the scanning signal $SC_2$ is at a LOW level.

By means of this scanning signal $SC_1$, the first TFTs 41 and 43 in the first and second pixel groups 28 and 29 are turned ON. By means of the scanning signal $SC_2$, the second TFT 42 of the first pixel group 28 is turned ON, and the second TFT 44 of the second pixel group 29 is turned OFF. In a time period $A_2$ (equal to the period H) from the time $t_{24}$ to the time $t_{26}$, the data signal SD is written into the pixels 12 of the first pixel group 28. The time $t_{26}$ is a rising timing of the scanning signal $SC_2$ to the (m+1)th row of the scanning signal line 19. Also, the second TFT 44 is in the OFF state in the second pixel group 29. Accordingly, the data signal SD is not written into the pixels 12 of the second pixel group 29.

At the time $t_{26}$ after the time period $A_2$ from the time $t_{24}$, the level of the scanning signal $SC_2$ to the (m+1)th row of the scanning signal line 19 is changed to a HIGH level. The second TFT 42 of the first pixel group 28 is turned OFF, and the second TFT 44 of the second pixel group 29 is turned ON. Thereby, the data signal SD written in the pixels 12 of the first pixel group 28 is held, and writing of the data signal SD to the pixel 12 of the second pixel group 29 is started. This writing is performed during a time period $B_2$ which terminates at the time $t_{25}$ when the scanning signal $SC_1$ falls. This time period $B_2$ can be selected to be much longer than the time period A mentioned above in connection with conventional arts. Accordingly, the data signal SD applied to the data signal line 18 can be selected to be long enough to charge the pixel electrode 22 of the second pixel group 29.

At the time $t_{25}$ after the time period $B_2$ from the time $t_{26}$, the level of the scanning signal $SC_1$ is changed to a LOW level. As a result, the first TFT 41 of the first pixel group 28 and the first TFT 43 of the second pixel group 29 are in the OFF state. In a time period following this, until the level of the scanning signal SC of the mth row of the scanning signal line 19 rises to a HIGH level again, the pixel electrodes 22 of the first and second pixel groups 28 and 29 in the mth row hold the written data.

Here, at the time $t_{25}$, the level of the scanning signal $SC_1$ shown by (6) of FIG. 12 is changed to a LOW level. As a result, the level of a scanning signal $SC_2$ to the (m+1)th row of the scanning signal line 19 which is to be scanned next is changed to a HIGH level by the scanning circuit 33. Hereby, the above-mentioned signals are respectively applied to the (m+1)th row of the scanning signal line 19, subsequent to the second TFT 42 of the first pixel group 28. In this way, the scanning signals SC are applied to all the scanning signal lines 19. Then, a display operation is performed.

The case where the switching element of the pixel 12 of the second pixel group 28 has a structure as shown in FIG. 11B or FIG. 11C will be described hereinafter. As shown by FIG. 11B, in the case of using a second TFT 44*a* which is an n-channel TFT, a gate of the second TFT 44*a* is connected to the scanning signal line 19. In the case as shown by FIG. 11C, a single n-channel TFT 43 is used, and a gate of the TFT 43 is connected to the scanning signal line 19. The structures shown by FIGS. 11B and 11C are electrically equivalent to each other, and the display operations thereof are the same.

The display operation in this case is similar to the display operation of Example 3. The display operation for the first pixel group 28 is the same as that of the above-mentioned Examples. Therefore, only the operation for the second pixel group 29 will be described hereinafter. When the level of the scanning signal $SC_1$ becomes a HIGH level at the time $t_{24}$, the TFTs 44*a* and 43 are turned ON. During a time period from the time $t_{24}$ to the time $t_{23}$, the image signal Sg to be displayed on the (m−1)th row of pixels 12 is outputted to the Nth column of data signal line 18. Because of this, the data signal SD to be displayed in the mth row of pixels 12 is not applied to the data signal line 18 of the second pixel group 29. Thus, at the time $t_{23}$, the image signal Sg to be displayed in the mth row of pixels 12 is output to the Nth column of data signal line 18. For this reason, the data signal $SD_3$ is applied to the pixel electrode 22 of the second pixel group 29 at least in a time period $C_2$ from the time $t_{23}$ to the time $t_{25}$ when the scanning signal $SC_1$ falls. The time period $C_2$ can be selected to be longer than the period A mentioned above in the description of conventional arts.

The effects of the aforesaid Examples are attained also with the display apparatus 40 of Example 3, which has thus constructed switching elements for the second pixel group 29.

In this Example 3, the method of dividing the display section 13 is not limited to such a way of classification that the first pixel group 28 and the second pixel group 29 contain the same number of columns of pixels 12. The configuration of TFTs 41, 43, 44 and 44*a* as an n-channel TFTs and the TFT 42 as a p-channel TFT may be reversed with respect to TFT conductivity form. In such a case, a polarity of the scanning signal SC to each scanning signal line 19 is reversed to the case of Example 3. Moreover, a monocrystal Si or an amorphous Si may be used for the TFTs 41, 43, 44 and 44*a* provided in a switching element for the pixel electrode 22, as exemplified by display apparatus 40 in Example 3. The same effects as those of the above-mentioned Examples are obtained by using a substrate made of monocrystal Si for the scanning substrate 15 and forming the drive section 14 of the above-mentioned Examples on the Si-substrate.

By using a matrix display apparatus and a method of driving the same according to the present invention, the following effects are obtained.

The number of components of a display apparatus can be reduced since there is no need to have a circuit element for driving the pixel group for each of the plurality of groups. The structure of the substrate on which the driving circuit element is provided can be simplified.

According to the present invention, all the pixel groups on the row of pixels can assure the conductivity period of the first and second switching elements, after the image signal to be displayed on the pixels within the group is sampled and output to all the data signal lines within the pixel group. As a result, an image signal can be written into the pixels of the remaining group without causing display irregularities. Accordingly, even if the time length of the horizontal scanning is short because of a large number of scanning signal lines, the image signal can be written into all the pixels of row direction without causing display irregularities, which results in significant improvement in the quality of a display image.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A matrix display apparatus comprising:

a plurality of pixels arranged in a form of a matrix, divided into a plurality of pixel groups each having at least two columns of the pixels;

a plurality of data signal lines for applying a data signal to the plurality of the pixels, the plurality of data signal lines being parallel with each other and being disposed between the plurality of pixels along a direction of a column;

a plurality M of scanning signal lines for applying a scanning signal to the plurality of the pixels, the plurality of scanning signal lines being parallel with each other and being disposed between the plurality of pixels along a direction of a row;

first switching means, disposed for each of the plurality of pixels, for allowing the data signal to be applied to the corresponding pixel based on the scanning signal, the first switching means being connected to the corresponding pixel, data signal line and scanning signal line;

second switching means, disposed for each of the pixels in at least one of the plurality of the pixel groups, for controlling a timing for allowing the data signal to be applied to the corresponding pixel, the second switching means being connected in series to the first switching means between the first switching means and the data signal line and data signal line driving means for sampling an image signal for each of the plurality of scanning signal lines at a predetermined timing within a horizontal scanning period for the corresponding data signal line and for outputting the sampled image signal to the corresponding data signal line as the data signal, said data signal being applied to the pixels connected to the mth scanning signal line for a period including the horizontal scanning period for the mth scanning signal line and a portion of the horizontal scanning period for an (m+1) th scanning signal line, where $1 \leqq m \leqq M-1$.

2. A matrix display apparatus according to claim 1 further comprising a plurality of control signal lines for applying a control signal to the second switching means, thereby controlling the timing for allowing the data signal to be applied to the corresponding pixel.

3. A matrix display apparatus according to claim 2, wherein the plurality of control signal lines are disposed for the pixels in each of the plurality of pixel groups.

4. A matrix display apparatus according to claim 2, wherein the plurality of control signal lines are disposed for the pixels in common in the plurality of pixel groups.

5. A method of driving a matrix display apparatus comprising:

a plurality of pixels arranged in a form of a matrix, divided into a plurality of pixel groups each having at least one column of the pixels;

a plurality of data signal lines for applying a data signal to the plurality of the pixels, the plurality of data signal lines being parallel with each other and being disposed between the plurality of pixels along a direction of a column;

a plurality M of scanning signal lines for applying a scanning signal to the plurality of the pixels, the plurality of scanning signal lines being parallel with each other and being disposed between the plurality of pixels along a direction of a row;

first switching means, disposed for each of the plurality of pixels, for allowing the data signal to be applied to the corresponding pixel based on the scanning signal, the first switching means being connected to the corresponding pixel, data signal line and scanning signal line;

second switching means, disposed for each of the pixels in at least one of the plurality of the pixel groups, the second switching means being connected in series to the first switching means between the first switching means and the data signal line; and data signal line driving means for sampling an image signal for each of the plurality of scanning signal lines at a predetermined timing within a horizontal scanning period for the corresponding data signal line and for outputting the sampled image signal to the corresponding data signal line as the data signal, the method including the steps of;

outputting the scanning signal for an mth scanning signal line for allowing the data signal to be applied to the pixels connected to the mth scanning signal line for a period including the horizontal scanning period for the mth scanning signal line and a portion of the horizontal scanning period for an (m+1)th scanning signal line, where $1 \leqq m \leqq M-1$; and closing the second switching means in the pixels in the mth scanning line for the portion of the horizontal scanning period for the (m+1)th scanning signal line.

6. A matrix display apparatus according to claim 1, wherein the second switching means in one of the plurality of the pixel groups has an opposite conductivity of the first switching means in another of the plurality of the pixel groups.

7. A matrix display apparatus according to claim 1, wherein the pixel groups contain a different number of columns of pixels from one another.

8. A matrix display apparatus according to claim 1, further comprising means for charging the data signal applied to the data signal line into an electrode of the pixel, wherein a length of time required for said charging is less than half the horizontal scanning period.

9. A matrix display apparatus according to claim 2, wherein said matrix has N columns and a falling time of the control signal is greater than or equal to a length of time required for charging the data signal applied to the data signal line plus a time when the image signal is sampled and output to the data signal line of an N/2 column and is less than or equal to a time when the image signal to be displayed is sampled and output to the data signal line of a first column plus a horizontal scanning period.

10. A matrix display apparatus comprising:

a plurality of pixels arranged in a form of a matrix, divided into a plurality of pixel groups each having at least two columns of the pixels;

a plurality of data signal lines for applying a data signal to the plurality of the pixels, the plurality of data signal lines being parallel with each other and being disposed between the plurality of pixels along a direction of a column;

a plurality M of scanning signal lines for applying a scanning signal to the plurality of the pixels, the plurality of scanning signal lines being parallel with each other and being disposed between the plurality of pixels alone a direction of a row;

first switching means, disposed for each of the plurality of pixels, for allowing the data signal to be applied to the corresponding pixel based on the scanning signal, the first switching means being connected to the corresponding pixel, data signal line and scanning signal line;

second switching means, disposed for each of the pixels in at least one of the plurality of the pixel groups, for controlling a timing for allowing the data signal to be applied to the corresponding pixel, the second switching means being connected in series to the first switching means between the first switching means and the data signal line;

data signal line driving means for sampling an image signal for each of the plurality of scanning signal lines at a predetermined timing within a horizontal scanning period for the corresponding data signal line and for outputting the sampled image signal to the corresponding data signal line as the data signal; and a plurality of control signal lines for applying a control signal to the second switching means, thereby controlling the timing for allowing the data signal to be applied to the corresponding signal, said plurality of control signal lines being disposed for the pixels in each of the plurality of pixel groups, wherein control signal lines in each of the plurality of pixel groups deliver different control signals to each of the groups.

11. A matrix display apparatus comprising:

a plurality of pixels arranged in a form of a matrix, divided into a plurality of pixel groups each having at least one column of the pixels;

a plurality of data signal lines for applying a data signal to the plurality of the pixels, the plurality of data signal lines being parallel with each other and being disposed between the plurality of pixels along a direction of a column;

a plurality M of scanning signal lines for applying a scanning signal to the plurality of the pixels, the plurality of scanning signal lines being parallel with each other and being disposed between the plurality of pixels along a direction of a row;

first switching means disposed for each of the plurality of pixels, for allowing the data signal to be applied to the corresponding pixel based on the scanning signal, the first switching means being connected to the corresponding pixel, data signal line and scanning signal line;

second switching means, disposed for each of the pixels in at least one of the plurality of the pixel groups, for controlling a timing for allowing the data signal to be applied to the corresponding pixel, the second switching means being connected in series to the first switching means between the first switching means and the data signal line and data signal line driving means for sampling an image signal for each of the plurality of scanning signal lines at a predetermined timing within a horizontal scanning period for the corresponding data signal line and for outputting the sampled image signal to the corresponding data signal line as the data signal, wherein said second switching means in the mth row is further connected to an (m+1)th scanning signal line, where $1 \leqq m \leqq M-1$.

* * * * *